United States Patent [19]

Blanchard

[11] Patent Number: 4,659,079

[45] Date of Patent: Apr. 21, 1987

[54] BOWLING TRAINING AID AND METHOD FOR USING SAME

[76] Inventor: William R. Blanchard, 1713 Dixon Blvd., Apt. 148, Cocoa, Fla. 32922

[21] Appl. No.: 759,158

[22] Filed: Jul. 26, 1985

[51] Int. Cl.[4] ..... A63B 69/00; B65D 85/00

[52] U.S. Cl. ..... 273/54 B; 150/52 A; 206/315.9; 224/919; 272/117; 383/902

[58] Field of Search ..... 273/54 B, 58 C, 58 D, 273/64, 413, 414; 150/52 A; 206/315.9; 224/218, 919; 272/77, 100, 108, 117; 383/117, 902

[56] References Cited

U.S. PATENT DOCUMENTS

| | | | |
|---|---|---|---|
| D. 125,988 | 3/1941 | Anderson . | |
| D. 149,869 | 11/1946 | Haney . | |
| D. 235,693 | 7/1975 | Tibbs . | |
| 1,802,682 | 4/1931 | Stupecky . | |
| 1,927,492 | 9/1933 | Halpin | 206/315.9 X |
| 3,281,883 | 11/1966 | Glantz | 273/54 B UX |
| 3,290,043 | 12/1966 | Sorensen | 272/68 |
| 3,653,660 | 4/1972 | Malhas | 150/52 A X |
| 3,889,950 | 6/1975 | Kasravi | 383/117 X |
| 4,220,333 | 9/1980 | Mercer | 273/54 B |
| 4,247,117 | 1/1981 | Reichert | 273/58 C X |
| 4,305,584 | 12/1981 | Leehan | 273/64 |
| 4,307,888 | 12/1981 | Ohle | 273/58 C X |
| 4,510,982 | 4/1985 | Sangroni | 224/919 X |

FOREIGN PATENT DOCUMENTS

| | | | |
|---|---|---|---|
| 339448 | 8/1920 | Fed. Rep. of Germany | 272/77 |
| 935116 | 6/1982 | U.S.S.R. | 272/108 |

*Primary Examiner*—Anton O. Oechsle

*Attorney, Agent, or Firm*—Ashburn & Richeson

[57] ABSTRACT

A bowling training aid and a method for using same to develop an improved arm swing, the aid comprising at least two intersecting loops of material with a closeable opening for inserting a bowling ball, a base for preventing the ball from rolling across a flat surface and a handle attached to the loops for holding the ball.

15 Claims, 6 Drawing Figures

BOWLING TRAINING AID AND METHOD FOR USING SAME

BACKGROUND OF THE INVENTION

The present invention relates to training devices and methods of using such devices associated with the sport of ten pin bowling and in particular to a training/carrying device adapted to hold a bowling ball.

Many devices for carrying bowling balls are known and several bowling exercise and/or training devices have also been described in the patent literature. Representative of such devices are U.S. Pat. Nos. 4,220,333 and 4,510.982.

U.S. Pat. No. 4,220,333 (Mercer) describes an elaborate bowling practice and/or exercise device in which "a cage-like structure defined by a plurality of flexible adjustable length straps to receive the bowling ball . . . and an adjustable split wrist band or strap to secure the device to the wrist area of the user . . . ". This patent describes a potentially hazardous training method in which a regular bowling ball is swung and released by a bowler and then cause by a cage-like structure attached to the bowler's wrist. In use this method of training would sem to produce severe shocks upon the wrist and hand of the user resulting in possible injury to the wrist. Furthermore, the device of this patent utilizes a relatively expensive light sensing apparatus to practice delivery of the ball.

U.S. Pat. No. 4,510,982 (Sangroni) desoribes a ball carrying system and bag for a spherical ball such as a basketball, soccer ball and/or bowling ball. The system of Sangroni comprises a ball bag of pliable material having external cords extending along major circles from a first common minor circle to a diametrically opposite second common minor circle with a separate cord used for carrying the bag. This device requires the use of an enclosing bag attached to support cords for holding a ball. Disadvantageously, the Savgroni device totally encloses the ball preventing identification of the ball contained therein.

Modern professional bowlers often utilize two bowling balls during practice and tournaments. Advantageously, use of two or more balls designed for use on varying lane surfaces increases bowling performanoe much like a golfer's use of different clubs for hitting the ball from different surfaces. Thus, a slipperier lane or oilier lane requires for optimum performance use of a different bowling ball from that used on a less slippery or dryer lane. Indeed bowling balls are commonly marked with colored "dots" to indicate the type of surface for which each ball is designed.

Professional bowlers often carry two balls in a single two-ball bag. These bags typically are bulky and have the disadvantage of placing the weight of two balls on one arm during use. Furthermore, the bowler must open these bags to determine whether the balls contained therein are suitable for the lanes assigned. Since the game of bowling and especially tournament bowling may require frequent changes in lane assignments, it would be advantageous for a bowler to have an inexpensive ball carrying device which, in addition to being strong yet lightweight, allows instant identification of the ball contained therein thereby saving valuable time during lane changes. Furthermore, it would be advantageous to provide a device which, in addition to carrying a bowling ball could be utilized to safely warm up before or between games without requiring the use of a lane.

SUMMARY OF THE INVENTION

The present invention is a bowling ball training aid/carrying device comprising a handle at least two loops of flexible material adapted to receive a bowling ball, the loops intersecting each other at two opposing portions of each loop comprising, respectively, a first intersection and a second intersection, the handle connectd to at least one loop proximate the first intersection; and fastening means associated with at least one of the loops, for opening and closing the loop to allow insertion and removal of a bowling ball.

The present invention further contemplates a method of training which utilizes the above described device whereby the accuracy of a bowler may be improved by developing a "grooved" arm swing. By the term "grooved arm swing" is meant the result of repetitious practice of a preferred swing motion of the bowling arm to approximate the desired swing of arm, wrist, hand and ball during bowling. By repetitious practice of a preferred swing pattern coordination between mind and body is developed to reinforce neuromuscular patterns necessary for repetition of the desired arm swing. It is believed that correct repetition improves accuracy by increasing the probability that the body will follow learned patterns of response even when a player loses concentration momentarily. The inventive method provides that a bowler standing with body erect on a planar surface such as a bowling lane or a level floor, grasp in one hand (first hand) a handle of a training aid as described above with fingers and palm only holding the handle. The thumb should be as relaxed as possible and both feet should be flat on the floor with a foot (first foot) opposite the hand holding the ball placed forward of the bowler's body. Thus a right-handed bowler will typically grasp the handle in the right hand with the left foot forward of his or her body. A bowler's foot may be defined as having a longitudinal axis running in heel-to-toe alignment. This longitudinal axis of the first foot of a bowler is parallel to the corresponding longitudinal axis of the bowler's second foot with both feet spaced apart a comfortable distance. The parallel longitudinal axes of each foot should also be spaced apart a distance normal for a typical walking gait. With both feet and body in a position as described above, the hand grasping the handle of a ball containing training aid is held in stright alignment with attached wrist and arm so that the handle of the aid is held parallel to the longitudinal axes of both feet. The aid is then swung forward and backward with respect to the body of the bowler with the arm and attached shoulder relaxed. The opposing arm should be swung in a similar but opposite motion with respect to the aid-holding arm.

DETAILED DESCRIPTION OF THE INVENTION

Figure 1:
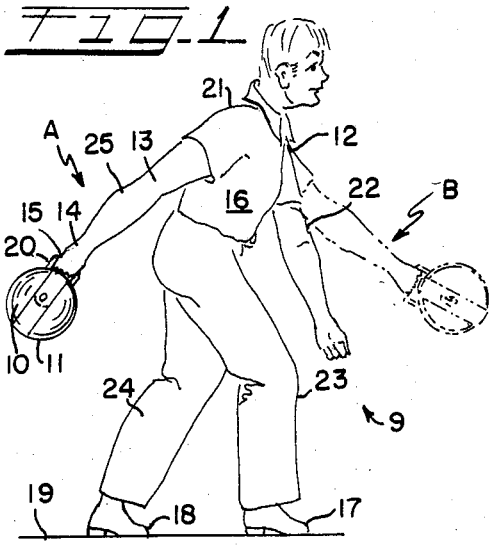
FIG. 1 is a side view of a bowler depicting a range of motion of the bowler's arm holding a device in accordance with the invention.

Referring to FIG. 1, a method 10 for improving the accuracy of a bowler by developing a grooved arm swing utilizing a training aid 11 of the present invention is depicted. The training aid 11 containing a ball 10 is held by a bowler 12 standing erect with arm 13, wrist 14, and hand 15 in straight alignment. Displaced forward from body 16 of bowler 12 is a first foot 17, said first foot 17 being opposite arm 13. Opposing said first foot 17 is second foot 18 held with its longitudinal (heel-to-toe) axis parallel to the longitudinal axis of first foot 17, both feet 17 and 18 being spaced apart and flat upon planar surface 19. With hand 15 grasping handle 20 of the training aid 11 so that handle 15 is held parallel with the longitudinal axes of said feet 17 and 18, the ball 10 and training aid 11 are swung straight forward and backward with respect to the bowler's body 16. This back and forth motion is repeated from position A to position B thereby developing a grooved arm swing. Arm 13 and shoulder 21 are maintained in a relaxed state during swing. Repetition of the swinging motion from position B to position A is believed to develop a "grooved arm swing" by reinforcing neuromuscular patterns necessary for repetition of the desired motion. Correct repetition of a desired bowling motion assists in maintaining good bowling form and improving accuracy by increasing the probability that a bowler's body 16, arms 13, 22 and legs 23, 24 will follow a conditioned pattern of response even if concentration is momentarily lost. The method 10 illustrated in FIG. 1 may also be used as a warm up exercise preliminary to bowling or between games. Advantageously, method 10 may be utilized to teach bowling, improve confidence, and overcome fears of dropping the bowling ball; this is especially beneficial for neophyte bowlers. The fear of dropping the ball during the back swing may be particularly acute in children who are just learning the game. Practice according to the described method not only overcomes these fears by building confidence, but also helps to safely condition and strengthen muscles utilized by this sport. Young or new bowlers may develop good skills from the start and experienced bowlers may overcome bad habits or ameliorate present skills.

Beneficially, a bowler 12 may improve his or her game by using the disclosed training aid 11 in normal use according to the described method 10. By not using the thumb to assist in gripping handle 20 the importance of pressure on the fingers of hand 15 is reinforced. When swinging the ball 10, the weight of the ball should be allowed to pull on the muscles of the upper part of arm 13 as much as possible to minimize tension in the hand 15, wrist 14 and elbow 25 areas. Also, swinging should be performed without twisting or turning handle 20 with the body 16 relaxed enough to allow the weight of ball 10 to carry the swing through to completion. Length of the swing will vary according to individual bowler physique and also according to the bowler's estimate of speed necessary to sufficiently overcome friction of a particular lane.

Figure 2:
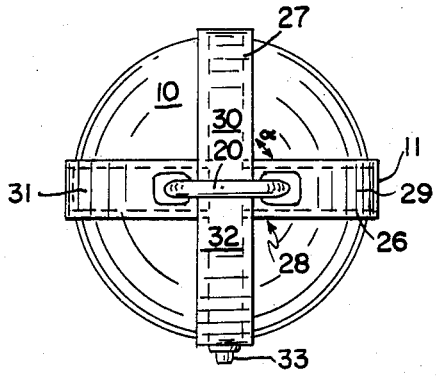
FIG. 2 is a top plan view of the inventive training aid/carrying device containing a bowling ball.

Referring now to FIG. 2, a top view of a ball 10 contained within a training aid/carrying device 11 is depicted. Two loops 26, 27 intersect at a first intersection 28 to form an angle alpha between first loop segment 29 of loop 26 and first loop segment 30 of loop 27. Loop 26 comprises first loop segment 29 and second opposing loop segment 31. Similarly, loop 27 comprises first loop segment 30 and second opposing loop segment 32. Handle 20 is attached to loop 26 proximate first intersection 28. Ball 10 is inserted and removed from device 11 by opening and closing fastening means 33 and loop segment 32. Opposite intersection 28, loops 26 and 27 intersect (see FIG. 3) at intersection 34.

Figure 3:
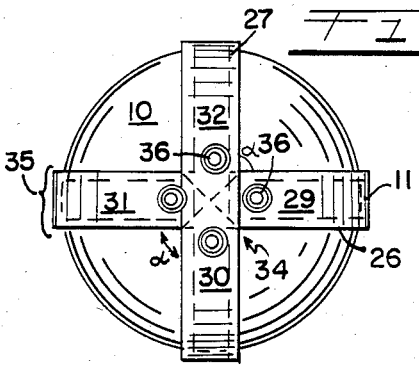
FIG. 3 is a bottom view of the device depicted in FIG. 2.

FIG. 3 shows loops 26 and 27 surrounding ball 10 at a second intersection 34 opposite first intersection 28 (see FIG. 2). Loop segments 29, 30, 31, and 32 meet at intersection 34 to form angles alpha. Preferably. two loops will be employed in forming the inventive device. Although both loops may be formed from a single length of material, preferably two lengths are used for ease of manufacture (one length for each loop). Also, more than two loops may be utilized for added strength although two are preferred. The angle alpha between adjacent loop segments 30, 31, and 29, 32 is preferably a right angle. In one embodiment of the invention which employs more than two loops, the angle alpha is typically in a range between about 10 and 90 degrees. Beneficially, alpha may be greater than or equal to 30 degrees and less than or equal to 90 degrees. An embodiment of the invention which utilizes 3 or 4 loops, advantageously, may employ at least one angle alpha of about 45 degrees.

Suitable loops are constructed of a flexible material such as heavy duty. vinyl coated nylon fabric. Materials used will beneficially be strong enough to withstand the stresses of swinging a bowling ball without allowing the ball to escape. Advantageously, loops 26. 27 will be formed of a flexible material comprising a strap having a width 35 of at least about 10% of the diameter of ball 10. Preferably, the strap width 35 is about 15% of the diameter of a bowling ball to be contained therein. Greater widths may be employed but tend to obscure the ball and increase costs due to use of more materiall than necessary. Preferably, device 11 employs loops 26, 27 having at least two opposing loop segments 29, 31 and 30. 32 for each loop 26 and 27, respectively. Loop segments 29, 30, 31, and 32 extend from first intersection 28 (see FIG. 2) to opposing second intersection 34 whereby the strap width 35 and the angle alpha between adjacent intersecting loop segments (e.g. segments 29 and 30) are sufficient to retain a bowling ball within loops 26, 27 during normal use. By "normal use" is meant the method 10 described above and also typical use as a carrying device to transport a bowling ball from one place to another by hand. A typical device 11 has a strap width 35 of at least 10% of the diameter of a bowling ball 10 with an angle alpha of at least 10%. Advantageously, device 11 is formed of two loops having a strap width 35 of 15% with an angle alpha being approximately 90% or a right angle. Device 11 also shows means for holding the device/aid 11 stationary upon a surface. Although several means may be employed to prevent the ball 10 and device 11 from rolling when set down, a plurality of shock-absorbing bumpers 36 may advantageously be attached proximate to the second intersection 34. These bumpers are commonly made of a rubber or plastic material which absorbs shock thereby preventing transmission of destructive forces to ball 10 when the ball containing device 11 is set down.

Figure 4:
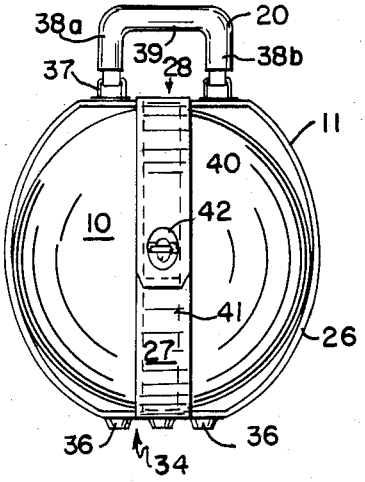
FIG. 4 is a side view of the device shown in FIG. 2.

FIG. 4 depicts a side view of a carrying device/training aid 11 containing ball 10. Handle 20 is attached to loop 26 proximate first intersection 28 by means of swivel attachment 37. Loop 26 is slightly longer than loop 27 to accommodate use of a conventional rigid plastic or metal suitcase-type handle 20 having ends 38*a* and 38*b* depending at right angles from gripping shaft 39. This larger loop 26 reduces stress at points of connection with handle 20. Proximate second intersection 34 are stationary holding means comprising a plurality of rubber bumpers 36. Loop 27 is split with upper strap portion 40 slightly overlapping lower strap portion 41 to accommodate fastening means 42. Beneficially, a turnbuckle type fastener having a ring attached to portion 40 and a turnbuckle attached to portion 41 is employed. Advantageously, turnbuckle fastening means 42 allows faster insertion and removal of a ball 10 than many known ball carrying devices, exercising devices, and/or training aids. Other commonly known fastening means may be employed.

Figure 5:
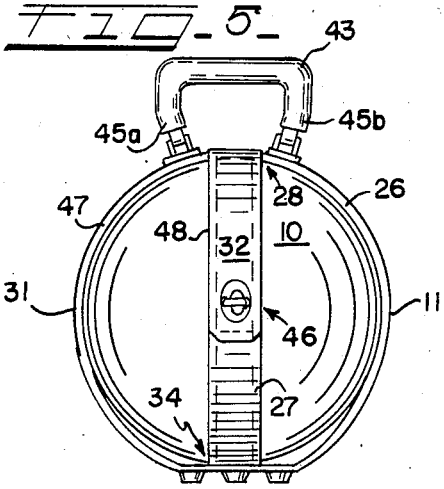
FIG. 5 is a side view of an alternate embodiment of the inventive device having a special handle.

Referring now to FIG. 5 a device 11 containing a ball 10 is shown with special handle 43 having gripping shaft 44 with opposing end portions 45*a*, 45*b* depending inwardly from shaft 44 in coaxial alignment with radii extending from center 46 of ball 10 retained within loops 26 and 27. By use of special handle 43, loop 26 need not be larger than loop 27 as depicted in FIG. 4, since the weight of ball 10 at contact points between handle 43 and loop 26 is more evenly distributed. Since loop 26 follows the ball's surface more closely a more esthetically pleasing device is presented. Advantageously. adjacent loop segments 31. 32 have adjacent edges 47 and 48, respectively, such that the combined length of edges 47 and 48 from first intersection 28 along edge 47 to second intersection 34 and along edge 48 back to first intersection 28 is less than the circumference of bowling ball 10 contained therein. This prevents bowling ball 10 from accidentally disengaging between said loop segments during use.

Figure 6:
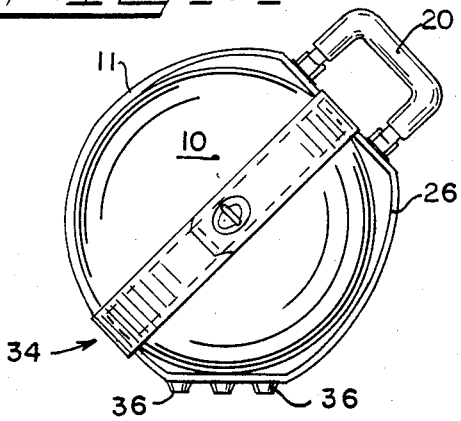
FIG. 6 is a side view of another alternate embodiment of the invention depiciting stationary holding means located on a side loop.

Referring now to FIG. 6, another embodiment of device 11 containing ball 10 is shown having fastening means such as bumpers 36 attached to loop 26 away from second intersection 34. This embodiment of the invention has the advantage of allowing easy access to handle 20 when the device is placed on a shelf or within a structure restricting top access but allowing side access. Thus, a proprietor of a bowling alley could utilize the inventive carrying device with house balls to reduce damage and/or accidents to balls and/or customers resulting from customer transport of one or more house balls from their storage area to assigned alleys and back. A further advantage of the present invention is that the carrying device/training aid may be folded up and stored either prior to sale or when not in use to occupy an area as little as 8"×4"×4".

The above description and following claims are illustrative of the invention, but should not be taken as limiting the scope to the particular embodiments or parameters described since modifications of these teachings will be apparent to those skilled in the art in view of present disclosure.

What is claimed is:

1. A bowling training aid comprising: a handle; at least two loops of flexible material adapted to receive a bowling ball, said loops intersecting each other at two opposing portions of each loop comprising, respectively, a first intersection and a second intersection. said handle connected to at least one loop proximate said first intersection; means for holding said aid stationary upon a planar surface; and fastening means. associated with at least one of said loops. for opening and closing said loop to allow insertion and removal of a bowling ball.

2. A training aid as defined in claim 1 wherein each of said loops comprises at least two loop segments extending from said first intersection to said opposing second intersection whereby adjacent loop segments have a combined adjacent edge length less than the circumference of said bowling ball.

3. A training aid as defined in claim 2 wherein said adjacent loop segments intersect to form an angle alpha where $10 < \text{alpha} \leqq 90°$.

4. A training aid as defined in claim 3 wherein $30 \leqq \text{alpha} \leqq 9O°$.

5. A training aid as defined in claim 3 wherein said angle alpha is about 45°.

6. A training aid as defined in claim 2 wherein said adjacent loop segments intersect at right angles.

7. A training aid as defined in claim 1 wherein said flexible material comprises a strap having a width of at least about 10% of the diameter of a bowling ball.

8. A training aid as defined in claim 7 wherein said strap width comprises about 15% of the diameter of a bowling ball.

9. A training aid as defined in claim 1 wherein: (a) said flexible material comprises a strap; and (b) each of said loops comprise at least two opposing loop segments extending from said first intersection to said opposing second intersection whereby said strap width and the angle between adjacent intersecting loop segments are sufficient to retain a bowling ball within said loops during normal use.

10. A training aid as defined in claim 1 wherein said stationary holding means comprise a plurality of shock-absorbing bumpers.

11. A training aid as defined in claim 1 wherein said bumpers are attached to said loops at said second intersection.

12. A training aid as defined in claim 1 wherein said handle comprises a rigid handle having an elongate gripping shaft with opposing end portions depending at right angles from said shaft.

13. A bowling training aid comprising: a handle; at least two loops of flexible material adapted to receive a bowling ball, said loops intersecting each other at two opposing portions of each loop comprising, respectively, a first intersection and a second intersection, said handle connected to at least one loop proximate said first intersection; and fastening means, associated with at least one of said loops, for opening and closing said loop to allow insertion and removal of a bowling ball; wherein said handle comprises a gripping shaft with opposing end portions adapted for attachment to at least one of said loops, said opposing end portions depending inwardly from said shaft in coaxial alignment with radii extending from the center of a bowling ball retained within said loop.

14. A bowling ball carying device comprising: a handle, at least two loops of flexible material adapted to receive a bowling ball, said loops intersecting each other at two opposing portions of each loop comprising, respectively, a first intersection and a second intersection, said handle connected to at least one loop proximate said first intersection; means for holding said device stationary upon a planar surface and fastening means, associated with at least one of said loops, for opening and closing said loop to allow insertion and removal of a bowling ball.

15. A method of training for improving accuracy of a bowler by developing a grooved arm swing comprising: (a) standing with body erect on a planar surface; (b) grasping in a first hand a handle of a training aid, with fingers and palm only holding said handle, said aid comprising: a handle, at least two loops of flexible material adapted to receive a bowling ball, said loops intersecting each other at two opposing portions of each loop comprising, respectively, a first intersection and a second intersection, said handle connected to at least one loop proximate said first intersection; and fastening means, associated with at least one of said loops, for opening and closing said loop to allow insertion and removal of a bowling ball; (c) placing a first foot of said body which is opposite said hand forward of said body with the longitudinal axis of said foot parallel to the longitudinal axis of said opposing second foot, with said second foot of said body spaced apart from first foot with both feet flat on said surface; (d) with said grasping hand in straight alignment with attached wrist and arm, said handle includes a longitudinal axis which is held parallel to said longitudinal axes of said feet; and (d) said training aid containing a bowling ball is swung forward and backward with respect to said body with shoulder and arm relaxed.

* * * * *